United States Patent [19]

Fette

[11] 4,164,626

[45] Aug. 14, 1979

[54] PITCH DETECTOR AND METHOD THEREOF

[75] Inventor: Bruce A. Fette, Mesa, Ariz.

[73] Assignee: Motorola, Inc., Schaumburg, Ill.

[21] Appl. No.: 903,264

[22] Filed: May 5, 1978

[51] Int. Cl.[2] ..... G10L 1/00
[52] U.S. Cl. ..... 179/1 SC; 179/1 D
[58] Field of Search ..... 179/1 SC, 1 P, 1 D; 73/67, 556, 559

[56] References Cited

U.S. PATENT DOCUMENTS

| | | | |
|---|---|---|---|
| 3,376,387 | 4/1968 | Cassel | 179/1 SC |
| 3,377,428 | 4/1968 | Dersch | 179/1 SC |
| 3,740,476 | 6/1973 | Atal | 179/1 SC |
| 4,000,369 | 12/1976 | Paul et al. | 179/1 P |

OTHER PUBLICATIONS

R. Barber et al., "Formant Tracking System", IBM Tech. Discl. Bull., vol. 8, No. 5, Oct. 1965, p. 756.
E. Nassimbene, "Voicing Detector", IBM Tech. Discl. Bull., vol. 7, No. 10, Mar. 1965, p. 923.

*Primary Examiner*—Kathleen H. Claffy
*Assistant Examiner*—E. S. Kemeny
*Attorney, Agent, or Firm*—M. David Shapiro; Eugene A. Parsons

[57] ABSTRACT

A pitch and voiced/unvoiced detector comprising a low pass filter or variable cutoff frequency low pass filter for providing a constant power output, DC shifting and weighting circuits operating on the filtered analog signals, a summing circuit for the filtered and weighted signals, a peak detector with controlled exponential decay time and timing circuits which are used to distinguish pitch and voiced/unvoiced structure in the analog input signal.

26 Claims, 9 Drawing Figures

FIG. 4D
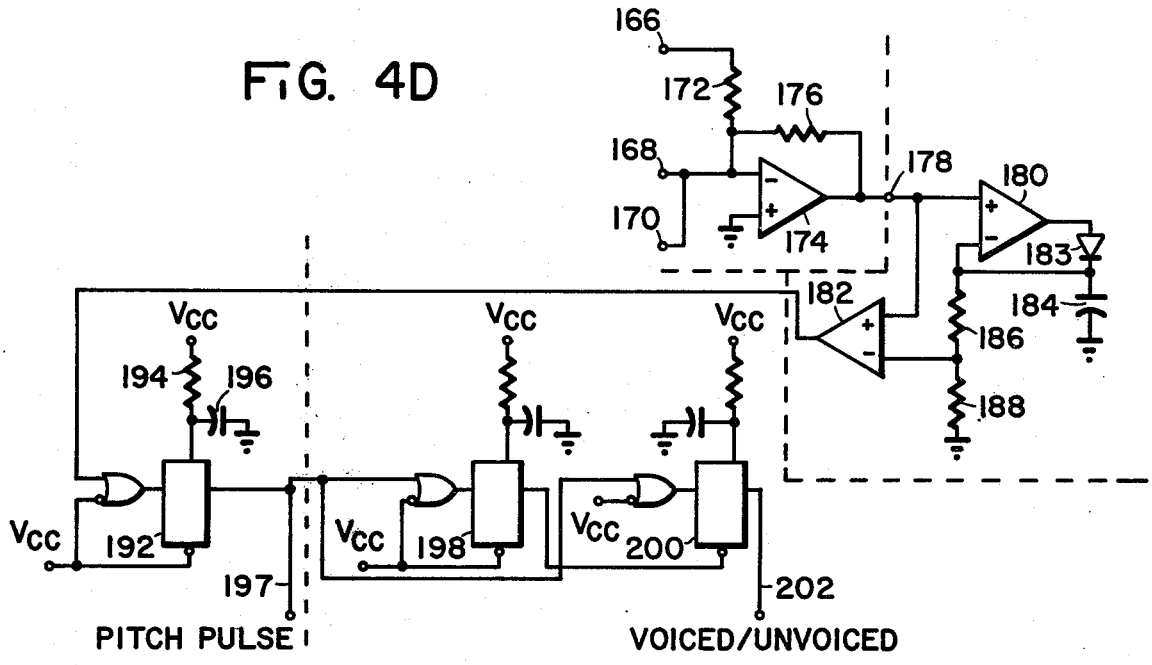
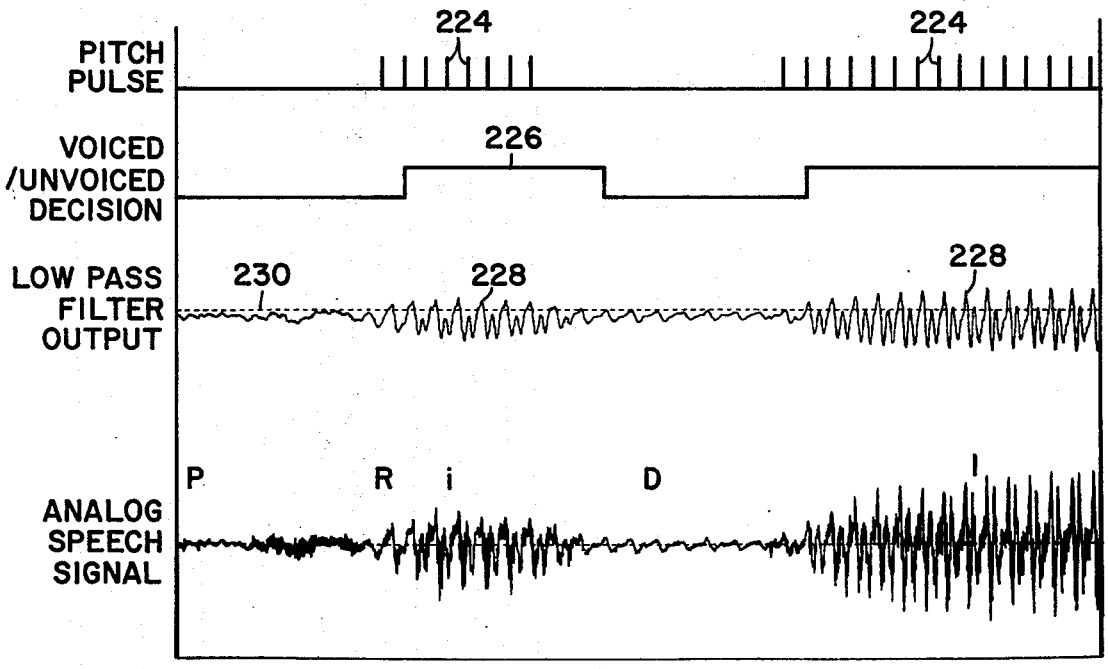
FIG. 5

PITCH DETECTOR AND METHOD THEREOF

BACKGROUND OF THE INVENTION

This invention relates to speech processing systems, and more particularly, to pitch detectors.

The pitch of a human voice is that component of speech produced by the vibration set up in the vocal cords of the speaker. In the speech process the vibrations of the vocal cords are convolved with resonant frequencies in the head of the speaker, known as formants, to produce a majority of the sounds heard in human speech. However not all of the common English sounds are produced in this manner. Some sounds do not involve the use of the vocal cords as for example sounds produced by bursts of sound, and sounds made by setting up turbulances inside of the head of the speaker.

Although the pitch is not present in every sound made by a human, it is highly desirable to be able to recover the pitch information for such functions as speech compression for transmission of analog speech with narrow bandwidths, and also for speech recognition by electronic means. Although the basic concept of pitch is readily understood, the subtleties of pitch are complex. See for example Schroeder, "Models of Hearing," 63 *Proceedings of the IEEE* 1332 (1975). Pitch detection has been a difficult problem in speech since the pitch range of many speakers is greater than 1 octave, and the pitch range of the population is 3 octaves wide. In general the pitch of a speaker is always at a lower frequency than the lowest formant frequency. However, in vowels of high first formant frequency, or in radio channels with low frequency cutoff above 100 hertz, the fundamental harmonic of the pitch frequency may be very low in amplitude compared with the energy of other harmonics in the speech waves. In general, linear filtering is not usually adequate to recover only the pitch fundamental. Computer programs have been developed using convolution techniques which are 90 to 95 percent successful in recovering pitch information. However these systems do not operate in real time, and involve the use of fairly extensive hardware.

Therefore it can be appreciated that a pitch detector which operates in real time and involves fairly inexpensive, commonly found electronic circuit elements is highly desirable.

SUMMARY OF THE INVENTION

The foregoing and other shortcomings and problems of the prior art are overcome, in accordance with the present invention by utilizing a circuit comprising low pass filtering means for limiting of an output signal thereof to the pitch frequencies of interest, weighting the input and output of the low pass filter by means of circuits which tend to hold the peaks. Weighting circuits are then used to limit output thereof to a controlled predetermined fraction of the input amplitude to the weighting circuit. The two weighting circuit outputs are DC shifted from the inputs and are summed with the low pass filter output which may have a variable cutoff frequency. The summer output pulses are time limited to provide pitch pulse outputs and voiced-/unvoiced outputs, both functions of the input analog signal, whether it be voice or other audio.

It is therefore an object of this invention to provide a pitch detector which operates in real time and is fairly inexpensive.

It is also an object of this invention to provide a pitch detector which selectively removes higher order components of an analog speech signal.

It is still another object of this invention to provide a pitch detector which makes voiced/unvoiced decisions on analog speech signals.

It is also an object of this invention to provide a pitch detector which recovers relatively fast from an abrupt change in an input signal.

It is another object of this invention to provide a pitch detector which places pitch pulses above a zero voltage reference line in an electronic circuit.

It is also an object of this invention to provide a method for recovering pitch information from human speech in real time by utilizing selective low pass filtering.

It is still another object of this invention to provide a method for recovering pitch information of human speech by low pass filtering and DC shifting of said speech signal by electronic means.

This invention in its broadest sense is a pitch detector. For example a pitch detector according to this invention comprises a low pass filter for attenuating speech components in an audio signal which are generally higher than human pitch frequencies to produce a filtered audio signal, and a DC shifting circuit coupled to the low pass filter and coupled to receive the audio signal and which causes the pitch peaks of the filtered audio signal to be above a reference voltage such that crossovers of the reference voltage occur substantially at a rate of twice the pitch frequency.

Also shown is a pitch detector comprising an automatic gain control (AGC) circuit coupled to receive an audio signal for producing a regulated audio signal having a constant average power, and a variable low pass filter coupled to the AGC circuit for extracting low frequency components of the audio signal which provide a fraction of the constant average power of the regulated audio signal wherein the low frequency components are substantially comprised of the pitch of the audio signal.

Also shown is a method for extracting pitch information from an audio speech signal which comprises the steps of filtering an audio signal for attenuating high frequency components of the audio signal to produce a filtered audio signal, and DC shifting the filtered audio signal by an amount proportional to the peak values of the audio signal and the filtered audio signal so as to place the pitch peaks of the filtered audio signal above a reference voltage such that crossovers of said reference voltage occur substantially at a rate of twice the pitch frequency.

Also disclosed is a method for detecting pitch information of an analog speech signal which comprises the steps of adjusting the amplitude of an audio signal to provide a constant average power audio signal, and low pass filtering the constant average power audio signal by varying the cutoff frequency of a variable low pass filter for producing a filtered audio signal having a constant average power which is a fraction of the average power of the constant average power signal wherein the filtered audio signal is substantially comprised of the pitch of the audio signal.

BRIEF DESCRIPTION OF THE DRAWINGS

FIG. 4A through 4E is a series of circuit diagrams of the blocks shown in FIGS. 1, 2, and 3.

FIG. 5 is a set of response curves taken from the circuit of FIG. 2.

DESCRIPTION OF THE PREFERRED EMBODIMENTS

Figure 1:
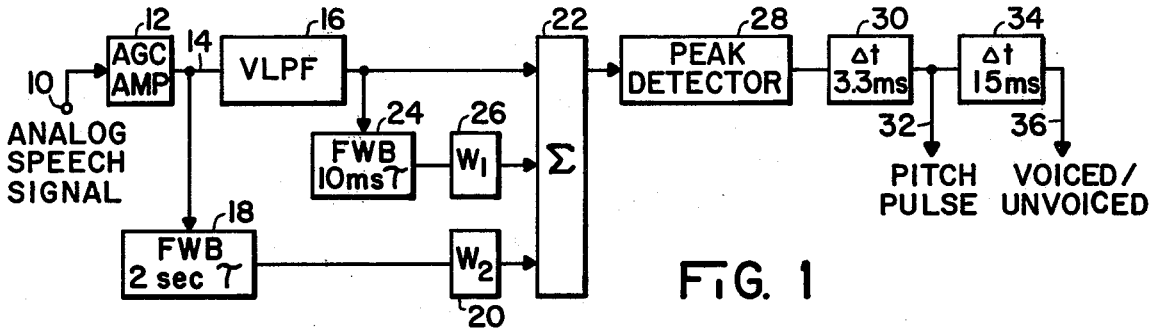
FIG. 1 is a block diagram of a first embodiment of the claimed invention.

Now referring to FIG. 1, an analog speech signal appears as an input at terminal 10 and is connected to the input of an automatic gain control (AGC) amplifier 12 which provides a constant average power signal at its output on line 14. This constant average power signal on line 14 is connected to the input of a variable cutoff frequency low pass filter (hereinafter referred to as VLPF) 16 which provides a constant average power signal which is a fraction of the average power of the input signal and consists of mainly lower frequency components. Also connected to line 14 is the input to a full wave bridge 18 which full wave rectifies the input signal and holds the peak value with a capacitor and a leakage resistor such that the capacitor charges instaneously to the peak input signal but decays at a rate determined by the time constant of the RC network. The output of full wave bridge 18 is connected to a weighting circuit 20, whose output is a linear fraction of its input amplitude signal. The output of this weighting circuit 20 is connected to a first input of a summing circuit 22. The output of the variable low pass filter 16 is connected to a second input of summing circuit 22 and also connected to the input of another full wave bridge 24 which operates identically to full wave bridge 18 except that the RC time constant is different in each of the two circuits. The output of full wave bridge 24 is connected to another weighting circuit 26 which proportions the output of full wave bridge 24 and supplies the porportioned output to a third input of the summing circuit 22. The summing circuit 22 linearly sums the three inputs and provides an output which is connected to a peak detector 28. Peak detector 28 holds peak positive values of the incoming AC signal and compares the present peak value to a voltage derived from previous positive peak signals. This circuit is described in more detail below. The output of peak detector 28 is fed into a timing circuit 30 which establishes a minimum time between repetitive output pulses of peak detector 28 which are passed to an output line 32 to thereby remove erroneous high frequency pitch pulses. The output timing circuit 30 is a pitch pulse appearing at line 32. The pitch pulse is also connected to a second timing circuit 34 which detects if a minimum time between pulses has occurred such that if two pitch pulses are received within a specified time, the circuit indicates on an output line 36 that a voiced analog speech signal is present at the input terminal 10.

In operation, an analog speech signal derived from a microphone or from a recording or other means appears at the input terminal 10 and is amplitude adjusted by AGC circuit 12 to provide a constant average power signal at line 14. This constant average power signal is in turn low pass filtered by the variable low pass filter 16 such that the output is at a constant predetermined average power with the higher frequencies only attenuated thus leaving mostly low frequencies containing pitch information at the output of variable low pass filter 16. The constant power signal on line 14 is connected to the full wave bridge 18 which has a 2 second time constant. The output of the full wave bridge 18 is essentially a DC signal connected to weighting circuit 20 to provide a 6 percent shift to the summing circuit 22. The output of variable low pass filter 16 is connected to another full wave bridge 24 having a time constant of 10 milliseconds and through weighting circuit 26 to provide a 30 percent shift in the DC level to the summing circuit 22. The 10 millisecond time constant is chosen to correspond to the measured amplitude time constant of a human voice. Added to these two weighted DC signals is the output of variable low pass filter 16. The resulting output of summing circuit 22 is the constant average power low pass filtered output of circuit 16 but DC shifted by a factor which substantially places only pitch pulses above the zero voltage potential of the resulting AC signal. These peaks are then detected by peak detector 28 which in turn provides pulses into delay circuit 30. Delay circuit 30 ignores any erroneous high frequency pulses by blocking any pulse occurring within 3.3 milliseconds after each pulse that is passed to the output. This corresponds to a frequency of 300 hertz, generally the highest pitch frequency generated by human voice. The output of timing circuit 30 is the pitch pulse. Timing circuit 34 detects if two or more pitch pulses occur within a 15 millisecond period. If at least two pitch pulses occur within this time period the output at line 36 signals a voiced input condition. If there are not two pitch pulses within a 15 millisecond period, then the output at line 36 indicates an unvoiced condition of the input terminal 10.

It should be noted that the pitch excitation of the human voice is such that pitch pulses tend to favor either a positive or a negative polarity dependent on microphone connection and the pitch detector may operate more satisfactorily if the analog speech signal connected to pin 10 is operating in one polarity compared to the inverted polarity.

Figure 2:
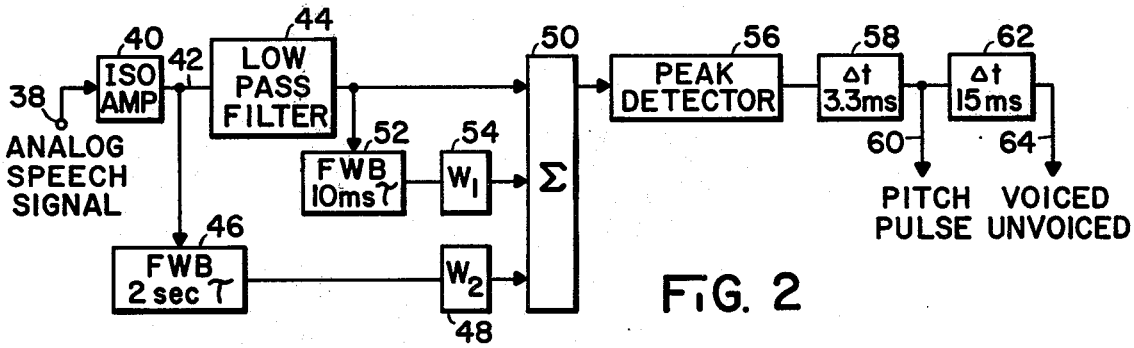
FIG. 2 is a block diagram of a second embodiment of the claimed invention.

FIG. 2 is a block diagram of a second embodiment of the invention wherein an analog speech signal appearing at input terminal 38 is connected to the input of an isolation amplifier 40. The output of the isolation amplifier appears at line 42 and is connected to the input of a low pass filter 44 which has a predetermined cutoff frequency. The signal appearing at line 42 is also connected to a full wave bridge 46, the output of which is coupled through a weighting circuit 48 into an input of a summing circuit 50. The output of the low pass filter is also connected to a second input of summing circuit 50 and also to the input of a full wave bridge 52. The output of full wave bridge 52 is coupled through a weighting circuit 54 into a third input of summing circuit 50. The output of summing circuit 50 is connected to the input of a peak detector 56, the output of which is connected to timing circuit 58. The output of timing circuit 58 is a pitch pulse appearing at line 60 and is also connected to the input of timing circuit 62, the output of which forms a voiced/unvoiced output at line 64. The second embodiment operates much like the embodiment of FIG. 1. The analog speech signal appearing at input terminal 38 is isolated by isolating amplifier 40 which in turn drives low pass filter 44 and full wave bridge 46. The signal appearing at line 42 is filtered by a two pole RC filter 44. From this point on the operation is exactly the same as in FIG. 1. That is full wave bridge 46 having a two second time constant is weighted by weighter 48 to produce a 6 percent change on the DC level of the filtered speech signal appearing at the output of low pass filter 44, and the output of the full wave bridge 52, having a 10 millisecond time constant, is weighted by weighting circuit 54 to have a 30 percent change on the DC level of the filtered speech signal appearing at the output of low pass filter 44. The output of the summing circuit 50 is peak detected by peak detector 56, and high pass filtered by timing circuit 58 to provide a pitch pulse at output line 60; and timing circuit 62 counts pitch pulses during a 15 millisecond time period to present a voiced/unvoiced decision at line 64.

Figure 3:
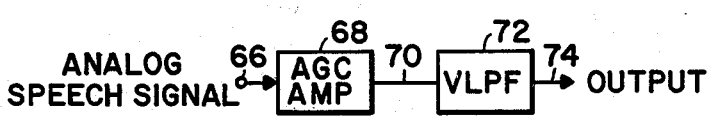
FIG. 3 is a block diagram of a third embodiment of the claimed invention.

FIG. 3 is a third embodiment of the pitch detector in which an analog speech signal appearing at input terminal 66 is adjusted by an AGC amplifier 68 to provide a constant average power signal at line 70 which in turn is low pass filtered by a variable low pass filter 72 which provides a constant average power signal at the output line 74 which contains the pitch pulse as its predominate frequency component. In operation the analog speech signal appearing at the input terminal 66 is adjusted by AGC amplifier 68 to a constant average power and then low pass filtered by the variable low pass filter 72 which provides a constant average power output which is a fraction of the input to the VLPF. The reduction in power is accomplished by variably low pass filtering the input signal. The cutoff frequency of the filter 72 is adjusted internally to provide a constant average power output. The output is a filtered speech signal having most of its energy in the pitch component.

Figure 4A:
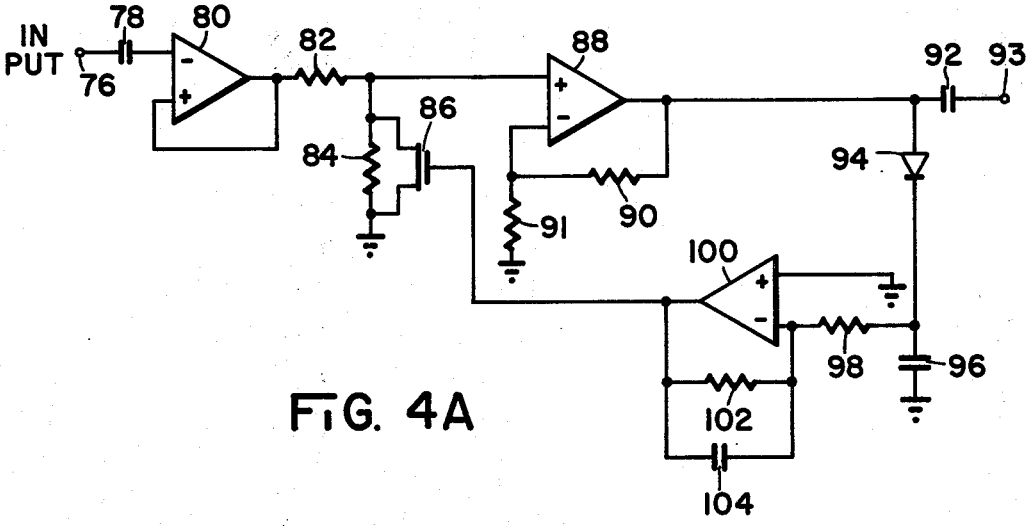

FIG. 4*a* is a circuit diagram of the AGC amplifier of block 12 of FIG. 1 and block 68 of FIG. 3. A signal appearing at the input terminal 76 is fed through a DC blocking capacitor 78 into the negative input terminal of an operational amplifier (op amp) 80 which is configured to operate as an isolation amplifier. The operational amplifiers used in these circuits may be any of a common type such as Motorola Part No. MC1458. The output of operational amplifier 80 is passed through a series resistor 82 and into a parallel shunt combination of a resistor 84 and field effect transistor (FET) 86 to ground potential. Resistor 82, and resistor 84 is parallel with field effect transistor 86, form a voltage divider the output of which is sensed by an operational amplifier 88 which has its positive input connected to the common junction of resistors 82 and 84. The output of operational amplifier 88 has a feedback resistor 90 to the negative input terminal which in turn is connected to resistor 91, the other end of which is connected to ground potential in the standard operational amplifier configuration. The output of the operational amplifier 88 is first, coupled through a series capacitor 92 to an output terminal 93 and second, coupled to the anode of a diode 94. The cathode of diode 94 is connected to a shunt capacitor 96, the other end of which is connected to ground potential, and also to a resistor 98 which in turn is connected to the negative input of an operational amplifier 100. The positive input of operational amplifier 100 is connected to ground, and the output of the operational amplifier is connected to a feedback resistor 102 and a feedback capacitor 104. The other ends of resistor 102 and capacitor 104 are also connected to the negative input terminal of operational amplifier 100. The output of operational amplifier 100 is also connected to the gate electrode of FET 86. In operation an input signal at terminal 76 is coupled through series capacitor 78, which blocks DC voltages appearing at the input terminal, and through isolation amplifier 80 to the voltage divider composed of resistor 82 and resistor 84 in parallel with FET 86. The output from the resistor divider is isolated and amplified by operational amplifier 88 and fed through series capacitor 92 onto output terminal 93. Also the output of operational amplifier 88 is diode rectified by diode 94, and high frequency voltages are filtered by capacitor 96. Resistor 98 couples the capacitor voltage to the input of the operational amplifier 100 and also provides a current path for charge from the capacitor 96 such that resistor 98 and capacitor 96 have an RC time constant equal to the product of their respective values. However the RC time constant is relatively short, on the order of one or two milliseconds. The feedback circuit consisting of resistor 102 and capacitor 104 of operational amplifier 100 has two separate functions. Resistor 102 sets a gain level for operational amplifier 100 thereby setting the output power level, and capacitor 104 prevents sharp changes in the output of operational amplifier 100 thereby providing a low pass filter for the feedback voltage. The time constant of resistor 102 and capacitor 104 in on the order of 30 milliseconds. The output of operational amplifier 100 in turn is connected to the gate of FET 86 which operates as a voltage controlled resistor to shunt resistor 84 and thereby provide a variable voltage divider. Thus the output of the AGC amplifier appearing at line 92 has a constant average power.

Figure 4B:
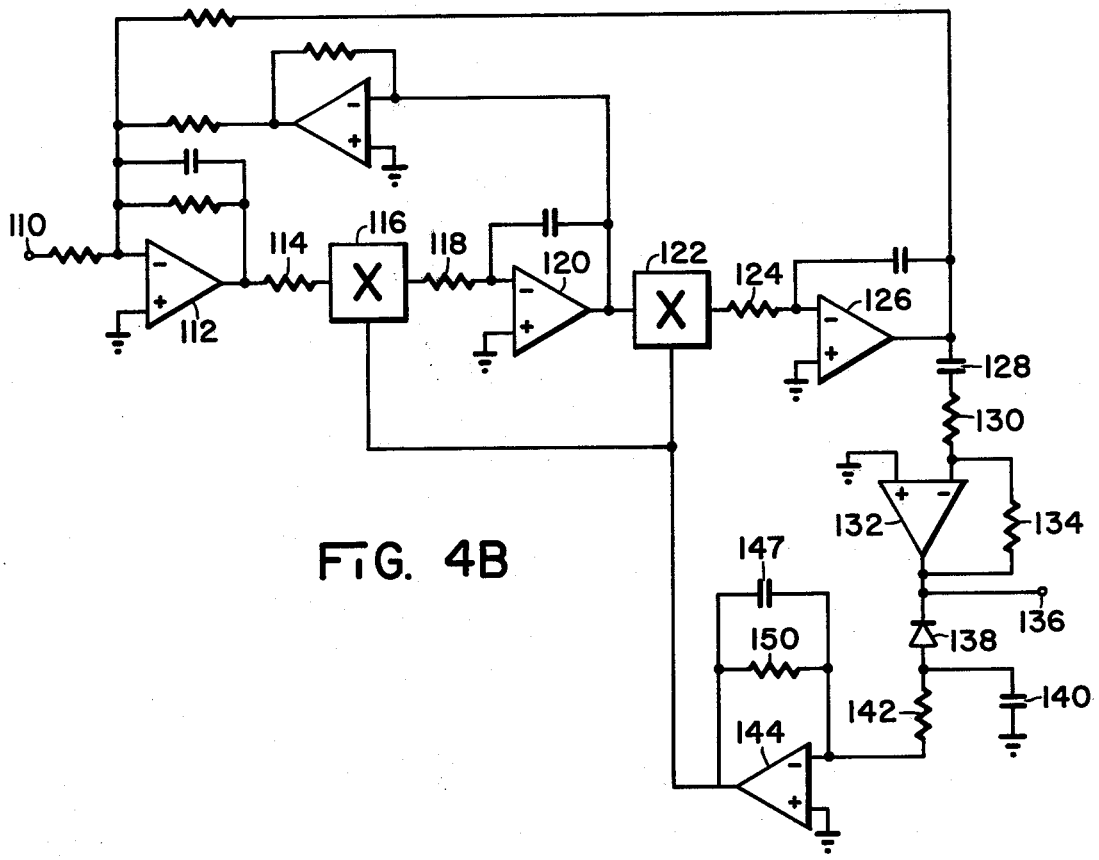

Turning now to the variable low pass filter of FIG. 4B, an input signal at terminal 110 is summed with feedback signals from other parts of the circuit at operational amplifier 112. The output of the operational amplifier 112 is fed through resistor 114 into a multiplier circuit 116. The output of the multiplier circuit is fed through resistor 118 into an integrating amplifier 120 the output of which is fed into a second multiplying circuit 122. The output of second multiplying circuit 122 is fed through resistor 124 into a second integrating amplifier 126 the output of which is fed back along with the output of first integrating operational amplifier 120 to be summed at the input terminal of operational amplifier 112. The circuit is described in more detail by Don Lancaster in *Active-Filter Cookbook*, Howard W. Sams and Co., Inc., Indiannapolis, Indiana, 1975 on pages 199 and 200. The output of this variable low pass filter, which is the output of operational amplifier 126, is fed through series capacitor 128 and series resistor 130 into the negative input terminal of an amplifying operational amplifier 132 having a feedback resistor 134 connected from the output to the negative input terminal and the positive input terminal of operational amplifier 132 is tied to ground. The output of operational amplifier 132 provides a variable low pass signal output at terminal 136. The output is also connected to the cathode of diode 138 which is part of the frequency control feedback circuit. The anode of diode 138 is fed into a high frequency filter capacitor 140 which is shunted to ground potential, and through resistor 142 into the negative input of operational amplifier 144, the positive input of which is connected to ground. The time constant of capacitor 140 and resistor 142 is on the order of one or two milliseconds to remove extraneous high frequency signals. Connected to operational amplifier 144 is a feedback network comprised of a capacitor 147 and a resistor 150 in parallel which are connected from the output of op amp 144 back to the negative input terminal. The time constant of resistor 150 and capacitor 147 is on the order of 30 milliseconds which corresponds to the time constant for changes in human pitch. The output of operational amplifier 144 is then connected to a second input of multipliers 116 and 122. In operation a signal appearing at input terminal 110 is low pass filtered as described by the aforementioned book at a frequency controlled by the voltage appearing at the input terminals of multipliers 116 and 122 from operational amplifier 144. The feedback frequency control circuitry consisting of diode 138, capacitor 140, resistor 142, capacitor 147, resistor 150, and operational amplifiers 144 operate as previously described for the AGC amplifier of FIG. 4A. Thus the output appearing at the terminal 136 of the variable low pass filter has an average power proportional to the average power appearing at the input of terminal 110 wherein the proportional power reduction has been accomplished by attenuating higher frequency components.

Figure 4C:
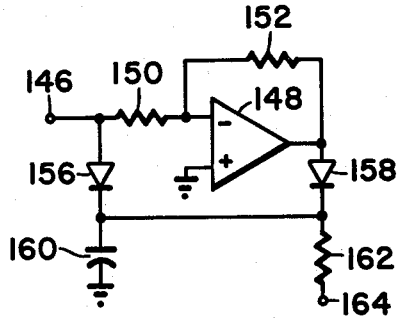

FIG. 4C is a circuit diagram for the full wave bridge of blocks 18 and 24 of FIG. 1 and blocks 46 and 52 of FIG. 2. An input terminal 146 is connected to the anode of a diode 156 and also connected to one end of a series resistor 150. The other end of resistor 150 is connected to the negative input of an operational amplifier 148 and to a feedback resistor 152. The positive input terminal of operational amplifier 148 is connected to ground potential. The output of operational amplifier 148 is connected to the other end of feedback resistor 152 and to the anode of a diode 158. The cathode of diodes 156 and 158 are connected together and to a shunt capacitor 160 to ground, and also connected to one end of a series resistor 162, the other end of which is connected to an output terminal 164. An input signal appearing at terminal 146 is inverted by operational amplifier 148 and its associated resistors 150 and 152 and the inverted and noninverted signals are rectified by diodes 158 and 156, and the peak values are held by capacitor 160. As previously mentioned, the inverting circuit of operational amplifier 148 in conjunction with diodes 156 and 158 provides full wave rectification of the input signal at terminal 146, and capacitor 160 holds the peak values between each half cycle. Resistor 162 however provides a leakage path for capacitor 160, and in the embodiments of FIG. 1 and FIG. 2 the product of capacitor 160 and resistor 162 determine the time constant of the full wave bridge of FIG. 4C. Also resistor 162 in conjunction with summing circuits 22 and 50 comprise weighting circuits 20, 26, 48 and 54 as described below.

FIG. 4D contains a circuit diagram for four separate blocks shown in FIG. 1 and FIG. 2. A summing circuit 22 of FIG. 1 and 50 of FIG. 2 has three inputs shown as 166, 168 and 170. Input terminal 166 is connected through resistor 172 to input terminals 168 and 170 and also to the negative input terminal of operational amplifier 174 which has a feedback resistor 176 from its output terminal at node 178 to the negative input terminal. The positive input terminal of operational amplifier 174 is connected to ground potential. For use in FIG. 1 input terminal 166 would be connected to the output of variable low pass filter 16, input terminal 168 would be connected to weighting circuit 26 and input terminal 170 would be connected to weighting circuit 20. In the preferred embodiment resistors 172 and 176 are the same value thereby providing an amplification factor of one; whereas the amplification of signals appearing at 168 and 170 would be determined by the source resistances of the driving networks. In the preferred embodiment the weighting circuits are incorporated into the full wave bridges; the output resistors 162 in conjunction with feedback resistor 176 provide the desired amplification or weight given the output from each of the full wave bridges. The output of the summing network appears at node 178 which forms the input to peak detector 28 of FIG. 1 and 56 of FIG. 2.

The peak detector circuit is comprised in FIG. 4D of operational amplifiers 180 and 182 which have their plus inputs connected to node 178. The output of operational amplifier 180 is connected to the anode of diode 183, the cathode of which is connected back to the negative input of operational amplifier 180 and also to one side of a shunt capacitor 184, the other side of which is connected to ground potential. A resistor 186 is connected at one end to the negative input terminal of operational amplifier 180, and the other end is connected to the negative input terminal of operational amplifier 182 and also to the one end of a shunt resistor 188, the other end of which is connected to ground. The output of operational amplifier 182 forms the output of the pitch detector at terminal 190. In operation an input signal appearing at line 178 is positive peak detected by operational amplifier 180 and diode 183, and the peak is held momentarily by capacitor 184. Resistors 186 and 188 form a voltage divider and a leakage path for charge from capacitor 184 such that the common point between resistors 186 and 188 is proportional to a positive peak of an input signal at node 178 and decreases at an exponental decay rate between input peaks depending on the value of capacitor 184 and the value of resistors 186, 188. Thus the voltage appearing across capacitor 184 is a decaying voltage between peaks, and the peak detector is a damped peak detector. The input signal at terminal 178 is also connected to operational amplifier 182. Operational amplifier 182 compares the input signal to the common voltage divider node of resistors 186 and 188 to differentiate positive input signals at terminal 178 from noise spikes or minor pulses at terminal 178.

The output of the peak detector at terminal 190 is then connected to the input of the timing circuit composed of monostable multivibrator 192 having timing resistor 194 connected to $V_{CC}$ and shunt timing capacitor 196. The output of monostable multivibrator 192 is connected to the pitch pulse output 197 which corresponds to output terminal 32 of FIG. 1 and terminal 60 of FIG. 2. The monostable multivibrator may be of any of a common type, as for example Motorola Part No. MC14528. The MC14528 part numbered device includes both elements shown in FIG. 4D for multi-stable flip-flops 192, 198 and 200; that is, the part includes the gate element shown in FIG. 4D, three places. This monostable multivibrator corresponds to the timing circuit of block 30 of FIG. 1 and block 58 of FIG. 2, and in the preferred embodiments has a time constant of 3.3 milliseconds. Thus a first pulse at the input terminal will be passed to output terminal 197 of FIG. 4D but a second pulse occurring within 3.3 millisecond time period from the first pulse will be ignored. Thus double pulsing or high frequency noise will be ignored by the one shot multivibrator 192. Finally monostable multivibrators 198 and 200 with their attentant timing networks provide the timing circuit of block 34 of FIG. 1 and block 62 of FIG. 2. The output of multivibrator 192 is connected to an input of monostable multivibrators 198 and 200; the output of monostable multivibrator 198 is connected to a second input of monostable multivibrator 200. The output of monostable multivibrator 200 is connected to a voiced/unvoiced output terminal 202 which corresponds to output terminal 36 of FIG. 1, and terminal 64 of FIG. 2. Again the monostable multivibrators may be of any of a common type such as Motorola MC14528. These two monostable multivibrators together provide a sample time wherein a time delay between successive pulses of less than 15 milliseconds will cause an output signal at terminal 202 to indicate a voiced condition, otherwise the output at terminal 202 will indicate an unvoiced condition.

Figure 4E:
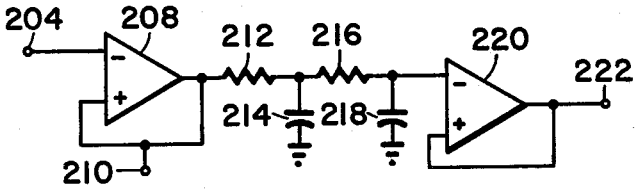

FIG. 4E is a schematic diagram of the isolation amplifier of block 40 and the low pass filter of block 44 of FIG. 2. The isolation amplifier has an input terminal 204 which is coupled into the positive input of an operational amplifier 208. The output of op amp 208 is connected back to the negative input of op amp 208 and also connected to an output terminal 210 which corresponds to connection 42 of FIG. 2. Low pass filter 44 of FIG. 2 is shown in FIG. 4E as a series resistor 212 one end of which is connected to the output of op amp 208, and the other end connected to a shunt capacitor 214 to ground, and to a second series resistor 216. The other end of resistor 216 is connected to a second shunt capacitor 218 to ground and also to the positive input of an operational amplifier 220. Op amp 220 is connected the same as op amp 208, and the output of op amp 220 is connected to an output terminal 222 which corresponds to the output of block 44 of FIG. 2. In operation, an input signal at terminal 204, analog speech, is applied to the positive input terminal of amplifier 208. Op amp 208 inverts the signal and provides isolation to the input from the rest of the circuitry, and also provides a low impedance source to the rest of the circuitry. Resistor 212 together with capacitor 214 form a single pole low pass filter, and resistor 216 together with capacitor 214 form a second single pole low pass filter. Each resistor capacitor combination has a time constant of about 400 milliseconds so that the combination of both filters provides a double pole low pass filter having a cutoff frequency of approximately 300 Hertz. Op amp 220 serves to isolate the low pass filter from the rest of the circuitry in a manner analogous to the operation of op amp 208.

FIG. 5 shows the response characteristics of the pitch detector of FIG. 2. On the top two lines are pitch pulses 224 and voiced/unvoiced decision pedestals 226. Note that the pitch pulses form a pulse train. On the third line is a DC shifted low pass filter output of block 50 of FIG. 2. Note that pitch peaks 228 extend above the dotted ground potential line 230. On the bottom line is an analog speech signal which would appear at terminal 38 of FIG. 2. The time period of the horizontal axis corresponds to 250 milliseconds, and the sounds produced correspond to letters "PREDI" of the word "PREDICTION" as shown above the analog speech signal. Note that certain of the letters, notably P and D, are plosive sounds and are unvoiced (not using the vocal cords as the sound source) during the oral closure and thus the pitch detector correctly discloses an unvoiced condition. During the times of these sounds the output of the summing network is below the ground voltage potential and thus there are not positive excursions for the peak detector to detect. However the sounds made by the letters R and I are voice sounds and the resulting lower frequency components are passed by the low pass filter and extend above the ground potential to thereby cause the peak detector to recognize the peaks. Two peaks in a row produce the voice decision at output terminal 64 of FIG. 2. Although the pitch is a troublesome quantity to detect electronically as can be seen from the analog speech signal of FIG. 55, it is not too hard to spot with the eye, the pitch being those low frequency peaks wherein the wave pattern is repeated. Thus it can be seen that the pitch detector accurately detects the pitch frequency of these sounds. It should be noted however that the pitch detector has certain limitations as when the analog speech signal has the fundamental pitch frequency missing or at a very low amplitude which sometimes occurs in radio transmitted speech.

A pitch detector has been shown which provides real time pitch information of an analog speech signal yet which is fairly inexpensive and utilizes common circuit elements. Also disclosed has been the method of operation of a pitch detector which uses inexpensive hardware and operates in real time, and in one embodiment utilizes a variable low pass filter to produce the pitch information. The pitch detector shown has the advantage of requiring a minimum number of operating adjustments plus the ability to recover from an abrupt change in the input signal in a relatively short period of time.

While the preferred embodiment is directed toward detecting human pitch, it will be recognized that the pitch detector can be used with other forms of audio signals such as musical instrument sounds.

While the invention has been particularly shown and described with reference to the preferred embodiments shown, it will be understood by those skilled in the art that various changes may be made therein without departing from the teachings of the invention. Therefore, it is intended in the appended claims to cover all such equivalent variations as come within the scope and spirit of the invention.

What is claimed is:

1. A pitch detector for extracting pitch information from an audio signal comprising:
   (a) low pass filter means coupled to receive the audio signal and for attenuating speech components in the audio signal generally higher than human pitch frequencies for producing a filtered audio signal; and
   (b) DC shifting means coupled to said low pass filter means and to receive the audio signal for causing the pitch peaks of said filtered audio signal to be above a reference voltage such that crossovers of said reference voltage occur substantially at a rate of twice the pitch frequency.

2. A pitch detector as set forth in claim 1 wherein said low pass filter means comprise a low pass filter having two real axis pole pair at 300 Hz.

3. A pitch detector as set forth in claim 1 wherein said DC shifting means comprises:
   (a) first peak detector means for providing a six percent DC shift in said filtered audio signal; and
   (b) second peak detecting means for providing an additional thirty percent DC shift in said filtered audio signal, wherein said second peak detecting means has a time constant equal approximately to the delay time constant of voiced sounds of humans, and said first peak detecting means having a time constant of approximately 2 seconds.

4. A pitch detector as set forth in claim 1 further comprising:
   (a) damped peak detector means coupled to said DC shifting means for providing an output pulse train substantially corresponding in frequency to the pitch of the audio signal.

5. A pitch detector as set forth in claim 4 further comprising:

(a) means coupled to said damped peak detector means for passing pulses to an output terminal which occur no sooner than a predetermined period of time from the previous pulse.

6. A pitch detector as set forth in claim 5 further comprising:

(a) pulse train detecting means coupled to said output terminal of said means for passing pulses and for determining if at least two pulses occur within a predetermined interval of time for indicating a voiced condition of the audio signal.

7. A pitch detector comprising:

(a) low pass filter means having a double pole response in the region of 300 Hz for receiving and filtering an incoming audio signal thereby producing a filtered audio signal;

(b) first full wave peak detector means coupled to said incoming audio signal and having a time constant substantially in the range of 1 to 2 seconds for averaging the peaks of said incoming audio signal;

(c) second full wave peak detector means coupled to said low pass filter means and having a time constant substantially in the range of 5 to 20 milliseconds for averaging the peaks of said filtered audio signal;

(d) summer means for summing said filtered audio signal, output of said first full wave peak detector means, and output of said second full wave peak detector means for producing a filtered audio frequency signal having excursions above a reference voltage equal in frequency to the pitch of said audio signal.

8. A pitch detector as set forth in claim 7 further including:

(a) third peak detector means having a time constant substantially in the range of 13 milliseconds for providing a decaying pulse signal of said pitch frequency of said audio signal;

(b) voltage divider and comparison means for dividing said decaying pulse signal by a predetermined amount and comparing said divided signal with said pitch signal for producing an output whenever said pitch signal is greater than said divided decaying pulse signal.

9. A pitch detector as set forth in claim 8 further comprising:

(a) means coupled to said voltage divider and comparison means for passing pulses to an output terminal which occur no sooner than approximately 3.3 milliseconds from the previous pulse.

10. A pitch detector as set forth in claim 9 further comprising:

(a) pulse train detecting means coupled to said output terminal of said means for passing pulses and for determining if at least two pulses occur within a fifteen millisecond time period for indicating a voiced condition of said audio signal.

11. A pitch detector comprising:

(a) input amplitude adjustment means for receiving an audio signal and for producing a regulated audio signal having a constant average power; and (b) variable cutoff frequency low pass filter means coupled to said input amplitude adjustment means for extracting low frequency components of said audio signal which provide a fraction of said constant average power of said regulated audio signal, said low frequency components being substantially comprised of the pitch signal of said audio signal.

12. A pitch detector as set forth in claim 11 wherein said fraction of said constant average power is a predetermined fraction.

13. A pitch detector as set forth in claim 12 further comprising:

(a) DC shifting means coupled to said regulated audio signal and to said variable low pass filter means for causing the pitch peaks of said low frequency components of said audio signal to be above a reference voltage such that crossovers of said reference voltage occur substantially at a rate of twice the pitch frequency.

14. A pitch detector as set forth in claim 13 further comprising:

(a) damped peak detector means coupled to said DC shifting means for providing an output pulse train substantially corresponding in frequency to the pitch of the audio signal.

15. A pitch detector as set forth in claim 14 further comprising:

(a) means coupled to said damped peak detector means for passing pulses to an output terminal which occur no sooner than a predetermined period of time from the previous pulse.

16. A pitch detector as set forth in claim 15 further comprising:

(a) pulse train detecting means coupled to said output terminal of said means for determining if at least two pulses occur within a predetermined interval of time for indicating a voiced condition of the audio signal.

17. A method of detecting the pitch frequency of an audio signal which comprises the steps of:

(a) filtering the audio signal for attenuating high frequency components of the audio siignal and thereby producing a filtered audio signal;

(b) DC shifting said filtered audio signal by an amount proportional to the peak values of the audio signal and said filtered audio signal so as to place the pitch peaks of said filtered audio siignal above a reference voltage such that crossovers of said reference voltage occur substantially at a rate of twice the pitch frequency.

18. A method of detecting the input audio signal which comprises the steps of:

(a) filtering the input audio signal with a low pass filter for attenuating frequencies greater than the highest anticipated pitch frequency for producing a filtered audio signal;

(b) DC shifting the input audio signal by approximately six percent of the peak signal with a peak detector having an exponential decay time constant of two seconds for producing a first DC offset voltage;

(c) DC shifting said filtered audio signal by approximately thirty percent of the peak signal with a peak detector having an exponential decay time constant substantially in the range of five to twenty milliseconds for producing a second DC offset voltage;

(d) summing said filtered audio signal, said first DC offset voltage and said second DC offset voltage for producing a shifted audio signal so as to place the pitch peaks of said filtered audio signal above a reference voltage and substantially all other components of said filtered audio signal below said reference voltage.

19. A method of detecting the pitch of an audio signal as set forth in claim 18 which further includes:

(a) peak detecting said summed audio signal with a peak detector having an exponentially decaying time constant substantially in the range of thirteen milliseconds for producing a damped peak signal;

(b) proportioning the amplitude of said damped peak signal by a predetermined amount for producing a proportionate damped peak signal;

(c) comparing said proportioned damped peak signal to said summed audio signal for providing a pulse train having a frequency substantially equal to the pitch of the audio signal.

20. A method of detecting the pitch of an audio signal as set forth in claim 19 further including:

(a) high frequency filtering said pulse train such that pulses occurring sooner than approximately 300 milliseconds are prevented from passing to the pitch pulse output terminal.

21. A method for detecting the pitch of an audio signal as set forth in claim 20 further including:

(a) sampling a period of time following each pulse for determining if a second pulse occurs within said time period for producing a voiced condition signal.

22. A method of detecting the pitch of an audio signal which comprises the steps of:

(a) adjusting the amplitude of the audio signal to produce a constant average power audio signal;

(b) low pass filtering said constant average power audio signal by varying the cuttoff frequency of a variable low pass filter for producing a filtered audio signal having a constant average power which is a fraction of the average power of said constant average power signal, said filtered audio signal substantially comprised of the pitch of the audio signal.

23. A method of detecting the pitch of an audio signal as set forth in claim 22 further including:

(a) DC shifting said filtered audio signal by an amount proportional to the peak values of said constant average power audio signal and said filtered audio signal so as to produce a shifted audio signal and to place the pitch peaks of said filtered audio signal above a reference voltage such that crossovers of said reference voltage occur substantially at a rate of twice the pitch frequency.

24. A method of detecting the pitch of an audio signal as set forth in claim 23 further including:

(a) peak detecting said shifted audio signal with a peak detector having an exponentially decaying time constant substantially in the range of thirteen milliseconds for producing a damped peak signal;

(b) proportioning the amplitude of said damped peak signal by a predetermined amount for producing a proportionate damped peak signal;

(c) comparing said proportioned damped peak signal to said shifted audio signal for providing a pulse train having a frequency substantially equal to the pitch of the audio signal.

25. A method of detecting the pitch of an audio signal as set forth in claim 24 further including:

(a) high frequency filtering said pulse train such that pulses occurring sooner than approximately 300 milliseconds are prevented from passing to the pitch pulse output terminal.

26. A method for detecting the pitch of an audio signal as set forth in claim 25 further including:

(a) sampling a period of time following each pulse for determining if a second pulse occurs within said time period for producing a voiced condition signal.

* * * * *